US005786546A

United States Patent [19]

Simson

[11] Patent Number: 5,786,546

[45] Date of Patent: Jul. 28, 1998

[54] STUNGUN CARTRIDGE

[76] Inventor: Anton K. Simson, 13227 Aubrey St., Poway, Calif. 92064

[21] Appl. No.: 919,388

[22] Filed: Aug. 28, 1997

Related U.S. Application Data

[60] Provisional application No. 60/025,165, Aug. 29, 1996.

[51] Int. Cl.[6] ..... F42B 5/03

[52] U.S. Cl. ..... 102/438; 102/293; 102/439; 102/502; 89/1.11; 124/57; 124/59; 222/5; 361/232

[58] Field of Search ..... 102/293, 438, 102/439, 434, 440, 502, 504; 89/1.11; 361/230, 232; 463/473; 124/57, 59, 71, 73, 74, 75, 77; 222/3, 5

[56] References Cited

U.S. PATENT DOCUMENTS

| | | | |
|---|---|---|---|
| 2,327,653 | 8/1943 | Lisle | 124/57 |
| 3,523,538 | 8/1970 | Shimizu | 128/404 |
| 3,626,626 | 12/1971 | Blanc | 361/232 |
| 3,803,463 | 4/1974 | Cover | 361/232 |
| 3,830,214 | 8/1974 | Curtis | 124/74 |
| 4,253,132 | 2/1981 | Cover | 361/232 |
| 5,078,117 | 1/1992 | Cover | 124/71 |
| 5,473,501 | 12/1995 | Claypool | 361/232 |
| 5,698,815 | 12/1997 | Ragner | 102/502 |

*Primary Examiner*—Harold J. Tudor

*Attorney, Agent, or Firm*—Henri J. A. Charmasson; John D. Buchaca

[57] ABSTRACT

A non-lethal incapacitating device comprises a pair of projectiles and trailing wires packaged in a cartridge mountable on the head of a stungun. The cartridge assembly includes a pair of light and directionally stable and non-invasive projectiles having tubular plastic flares, expanded trailing wire coiled in double layers on a rotating magazine, a simple gas capsule side-piercing mechanism, and a compact housing.

9 Claims, 2 Drawing Sheets

STUNGUN CARTRIDGE

PRIOR APPLICATION

This application claims the benefits of provisional application Ser. No. 60/025,165 filed Aug. 29, 1996.

FIELD OF THE INVENTION

This invention relates to stunguns and other non-lethal incapacitating weapons designed for personal self-defense as well as for offensive use by law enforcement officer in apprehending threatening individuals.

BACKGROUND OF THE INVENTION

Stunguns are designed to deliver a high voltage discharge between electrodes protruding from their distal end. Early versions of those devices required near or actual contact of the electrodes with the skin surface of the targeted victim. The range of this early type of stungun was expanded by mounting on their distal end and over the discharge electrodes a cartridge containing a pair of barbed balls or dart projectiles attached to trailing wires in contact with the electrodes and various propelling media including compressed gas held in a capsule that can be pierced by a wedge driven by a detonator, the detonator being fired by the electric discharge available between the electrodes. This type of medium range-stunning apparatus is exemplified by the device disclosed in U.S. Pat. Nos. 4,253,132 Cover and 5,078,117 which patents are incorporated herein by this reference.

The darts consisted of a short cylindrical slug tipped at its distal end by a barbed point and attached at the opposite end to the voltage-carrying trailing wire. The darts and the barbed balls constitute a serious hazard for the eyes of the targeted individual.

The storage of the trailing wires in their cartridge compartments was labor-intensive since it requires coiling or folding each wire back and forth in a loose pile within each compartment.

The cartridge-piercing mechanism which was applied to the bottom of the cartridge, required a relatively long housing that interferred with an efficient use of the propelling gas.

Finally, the firing mechanism used a series of components which increased both its cost and assembly time.

The instant invention results from efforts to remedy the above-described flaws.

SUMMARY OF THE INVENTION

More specifically, the principal object of the invention is to provide a very compact projectile cartridge housing a complete set of projectiles and expended lengths of voltage-carrying trailing wires. Another object of the invention is to provide a stungun projectile that is non-intrusive.

It is also an object of this invention to provide a lighter and less complex stungun cartridge mechanism than the one found heretofore in the prior art.

These and other valuable objects are achieved by forming a projectile comprising a rounded metal end followed by a tubular plastic flare, and by repackaging the gas capsule in a transversal position and piercing its side with a simplified detonator-driven piercing wedge mechanism. The trailing wires are coiled in a double layer around a simply circular bobbin. The projectiles are devoid of any sharp appendage and are stabilized by a simple tubular flare.

DESCRIPTION OF THE PREFERRED EMBODIMENT OF THE INVENTION

Figure 1:
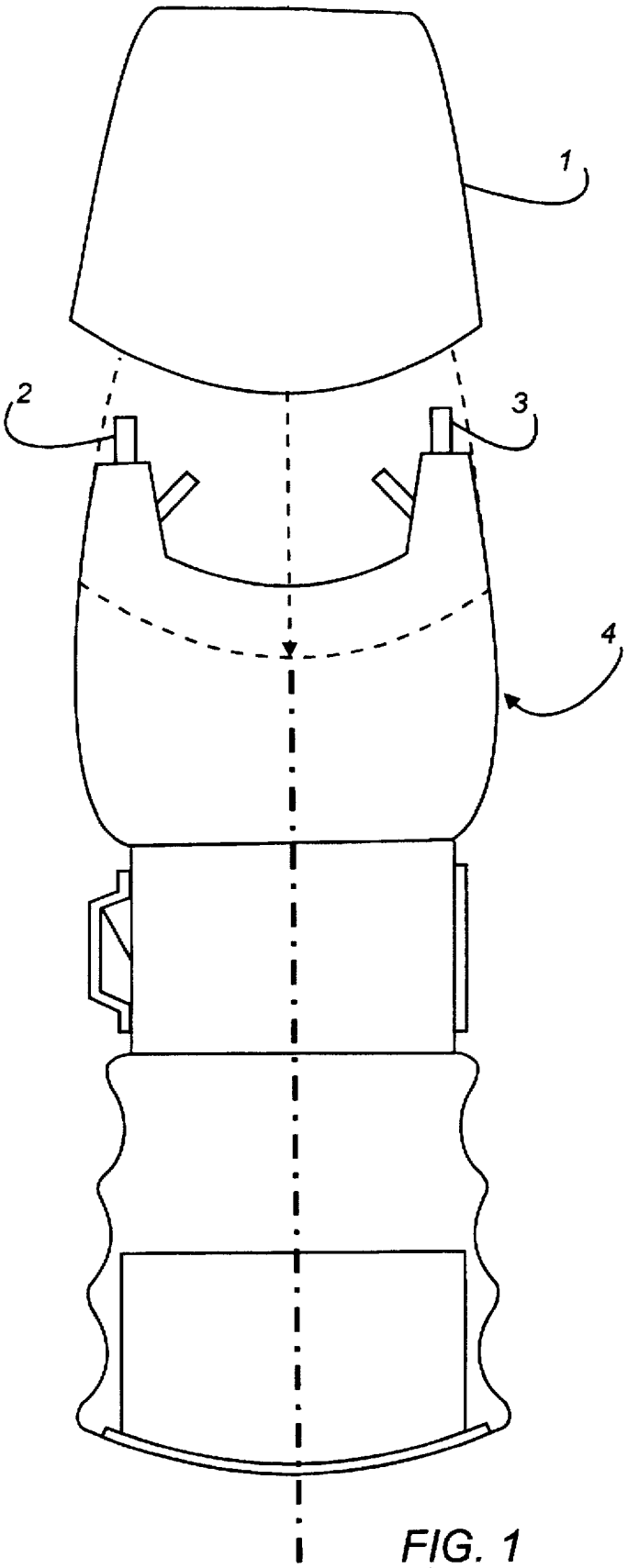
FIG. 1 is an exploded top plan view of a stun gun and cartridge according to the invention.

Referring now to the drawing, there is shown a cartridge 1 mountable over the discharge electrodes 2, 3 of a stungun 4. The cartridge is made of two similar half-sections which are bonded together around the mechanism. FIG. 1 illustrates one of said half sections. The cartridge mechanism comprises two projectiles 5, 6 which can be propelled at the expansion of gas escaping from a pressurized capsule 7. Each projectile 5, 6 is attached to a trailing wire 8, 9 wound around a pair of spools or reels 10, 11 held in housings 12, 13 located above and below the projectiles. Resting against the side of the gas capsule 7 is a wall piercing bullet 14 which can be shot through the wall of the capsule 7 by ignition of a pyrotechnic charge 15. The pyrotechnic charge 15 is in electrical contact with a first conductor 16 whose other end is in contact with one of the discharge electrodes 2 of the stungun. The casing 17 associated with the bullet and holding the charge is electrically connected by a second wire 18 to the other electrode of the stungun. Thus, any high voltage applied to the electrodes of the stungun will discharge through the pyrotechnic charge 15. The explosion of the charge will propel the bullet 14 against the wall of the cartridge 7, piercing that wall and causing escape of the compressed gas in the cartridge.

Figure 5:
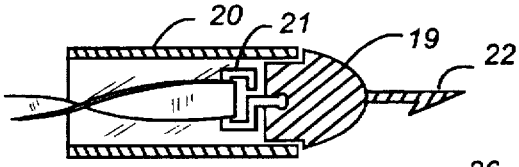
FIG. 5 is a longitudinal cross-section of an alternate embodiment of the projectile.
Figure 4:
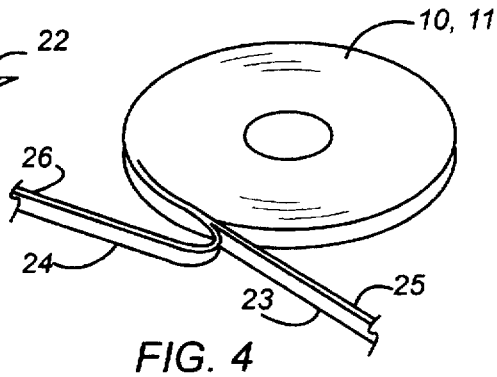
FIG. 4 is a perspective view of a trailing wire reel.

Each projectile 5, 6 comprises a head 19 preferably made of metal or of any appropriate relatively high density material and engaged into the end of a tubular flare 20 which may be made out of a section of plastic tubing. A suitable attachment means 21 is provided in the back of the head 19 for the distal end of a trailing wire 8, 9. The head 19 can be rounded or tipped by a barbed point 22 as shown in FIG. 5 for quick attachment to the garment or epiderm of a target.

Each trailing wire 8, 9 is preferably made of a flat, ribbon-like structure rather than a round, filiform one. A metal-coated Mylar brand of tape is recommended. Two layers of tape 23, 24 are bonded together by a light, easily breakable adhesive and the bonded layers are wound together around one of the spools 10, 11. The inner ends of the tape layers are mechanically and electrically tied together in the center of the spool. One of the outer extremities 25 of the double tape is attached to the head 19 of one of the projectiles while the other extremity 26 is mechanically attached to the cartridge 1 and electrically connected to one of the stungun electrodes 2, 3. As the projectile is ejected out of the cartridge, the pulling force on the first extremity 25 of the tape cause the tape to unwind from the spinning spool separating on layer 23 from the other 24 which accumulates for a while within the reel chamber 12, 13 until such time as the tape is completely unwound from the spool, at which point the accumulated second layer 24 of the tape begins to exit the cartridge until the associated projectile reaches its target or both layers of the tape have been completely pulled out of the cartridge.

Since the tied-down extremities 26 of each tape are electrically connected to one of the terminals 27, 28 that are in contact with opposite electrodes of the stungun, the high voltage present between the electrodes is carried toward the target by the projectiles 5, 6. When the two projectiles hit a target, a high voltage discharge takes place between the two areas of the target impinged by the projectiles. It should be noted that if only one of the projectiles hits the target and the second one falls to the ground, a discharge will occur, nevertheless, across the target and a portion of ground that separates the target from the area in contact with the fallen projectile.

Although the head 19 may not provided with any kind of hook or barbed point for attachment to the target epiderm or clothing, a good contact is established when the projectile and a leading section of the trailing tape wrap themselves around a portion of the targeted individual's body.

Figure 2:
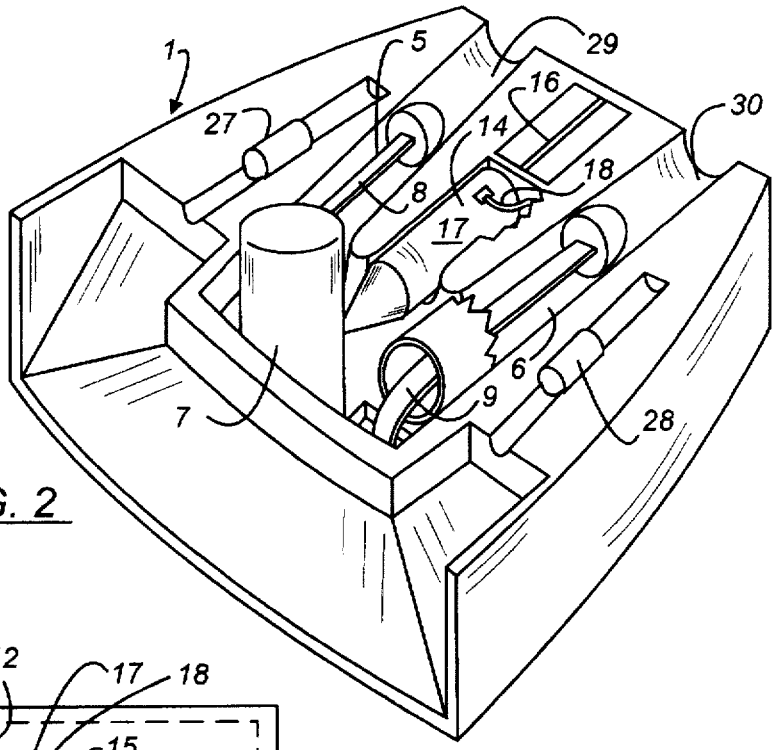
FIG. 2 is a horizontal median cross-section of the stungun cartridge.
Figure 3:
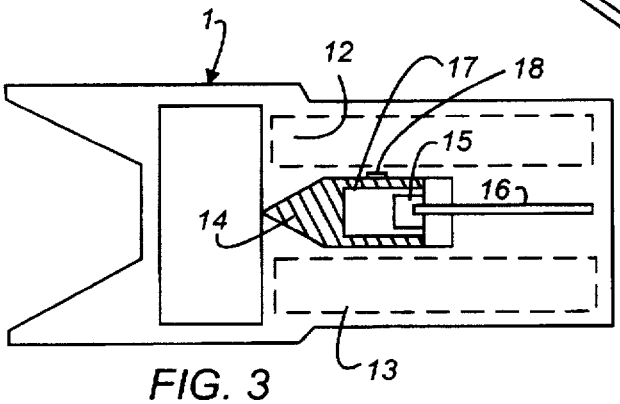
FIG. 3 is a vertical median cross-section thereof.

The terminals 27, 28 which are only partially shown in FIG. 2, are connected to the conductors 16, 18 leading to the casing 17 of the bullet and to the pyrotechnic charge 15 respectively.

The gas capsule housing, the reel chambers 12, 13, and the open area immediately behind the projectiles as well as the section housing the bullet 14 constitute a single expansion chamber for the pressurized gas.

The projectiles lie in a pair of slightly divergent barrels 29, 30 which direct them to spaced-apart locations on or near the target.

While the preferred embodiments of the invention have been described, modifications can be made and other embodiments may be devised without departing from the spirit of the invention and the scope of the appended claims.

What is claimed is:

1. A-stungun projectile cartridge which comprises:

a housing defining a plurality of compartments including:

first and second barrel compartments, first and second spool compartments, a capsule compartment, a detonator compartment, each of said compartments having a longitudinal axis;

first and second electrical terminals;

first and second projectiles each in one of said barrel compartments;

a spool rotatably held in each of said first and second spool compartments;

first and second lengths of electrically conductive wire parallelly coiled in multiple layers upon each of said spools each of said lengths having a distal end segment unwinding from a peripheral portion of said spool and attached to one of said projectiles, and a proximal end segment in electrical contact with one of said terminals;

a tubular compressed gas propellant capsule held in said capsule compartment; and a detonator held in said detonator compartment and having a piercing bullet head proximal to a lateral section of said capsule.

2. The cartridge in claim 1, wherein a longitudinal axis of said capsule is substantially perpendicular to the longitudinal axis of said detonator compartment.

3. The cartridge in claim 2, wherein the longitudinal axes of said first and second barrel compartments and said detonator compartment lie in a substantially common plane.

4. The cartridge in claim 1, wherein each of said projectiles comprises:

a metallic head having a forward end and a trailing end; and a tubular flare engaged over said trailing edge.

5. The cartridge of claim 4, wherein said projectiles are devoid of any sharp appendages.

6. A stungun projectile cartridge comprises a pair of projectiles having trailing wires connected to highly charged terminals, said projectiles are held in adjacent barrels, an elongated capsule of compressed propellant gas is positioned to be pierced in a lateral section by a detonator and to discharge said gas into said barrels, and said elongated capsule being axially perpendicular to said barrels.

7. The improvement of claim 6 which further comprises:

a pair of rotatable spools around which said trailing wires, respectively are parallelly coiled in multiple layers.

8. The improvement of claim 6 which further comprises:

at least one of said projectiles having a trailing edge; and a tubular flare engaged over said trailing edge of said projectile.

9. The improvement of claim 6 wherein said projectiles are devoid of any sharp appendage.

* * * * *